United States Patent [19]

Newton et al.

[11] 4,065,278

[45] Dec. 27, 1977

[54] PROCESS FOR MANUFACTURING LIQUEFIED METHANE

[75] Inventors: Charles L. Newton, Bethlehem; Lee S. Gaumer, Allentown, both of Pa.

[73] Assignee: Air Products and Chemicals, Inc., Allentown, Pa.

[21] Appl. No.: 673,162

[22] Filed: Apr. 2, 1976

[51] Int. Cl.[2] ..... F25J 3/02

[52] U.S. Cl. ..... 62/26; 62/27; 62/40; 62/38

[58] Field of Search ..... 62/23, 26, 27, 38, 39, 62/40

[56] References Cited

U.S. PATENT DOCUMENTS

| | | | |
|---|---|---|---|
| 3,292,380 | 12/1966 | Bucklin | 62/38 |
| 3,397,138 | 8/1968 | Bacon | 62/38 |
| 3,433,026 | 3/1969 | Swearingen | 62/39 |
| 3,593,535 | 7/1971 | Gaumer et al. | 62/23 |
| 3,763,658 | 10/1973 | Gaumer et al. | 62/40 |

*Primary Examiner*—Norman Yudkoff

*Attorney, Agent, or Firm*—Ronald B. Sherer; E. Eugene Innis; Barry Moyerman

[57] ABSTRACT

A process for producing liquefied natural gas from a high pressure hydrocarbon feedstock is shown. In this process, the feedstock is isentropically expanded and distilled at a pressure lower than the critical pressure to form an overhead rich in methane and a bottom fraction. The methane rich overhead is compressed utilizing the energy obtained from the expansion and then the compressed overhead is liquefied in a refrigeration cycle.

4 Claims, 1 Drawing Figure

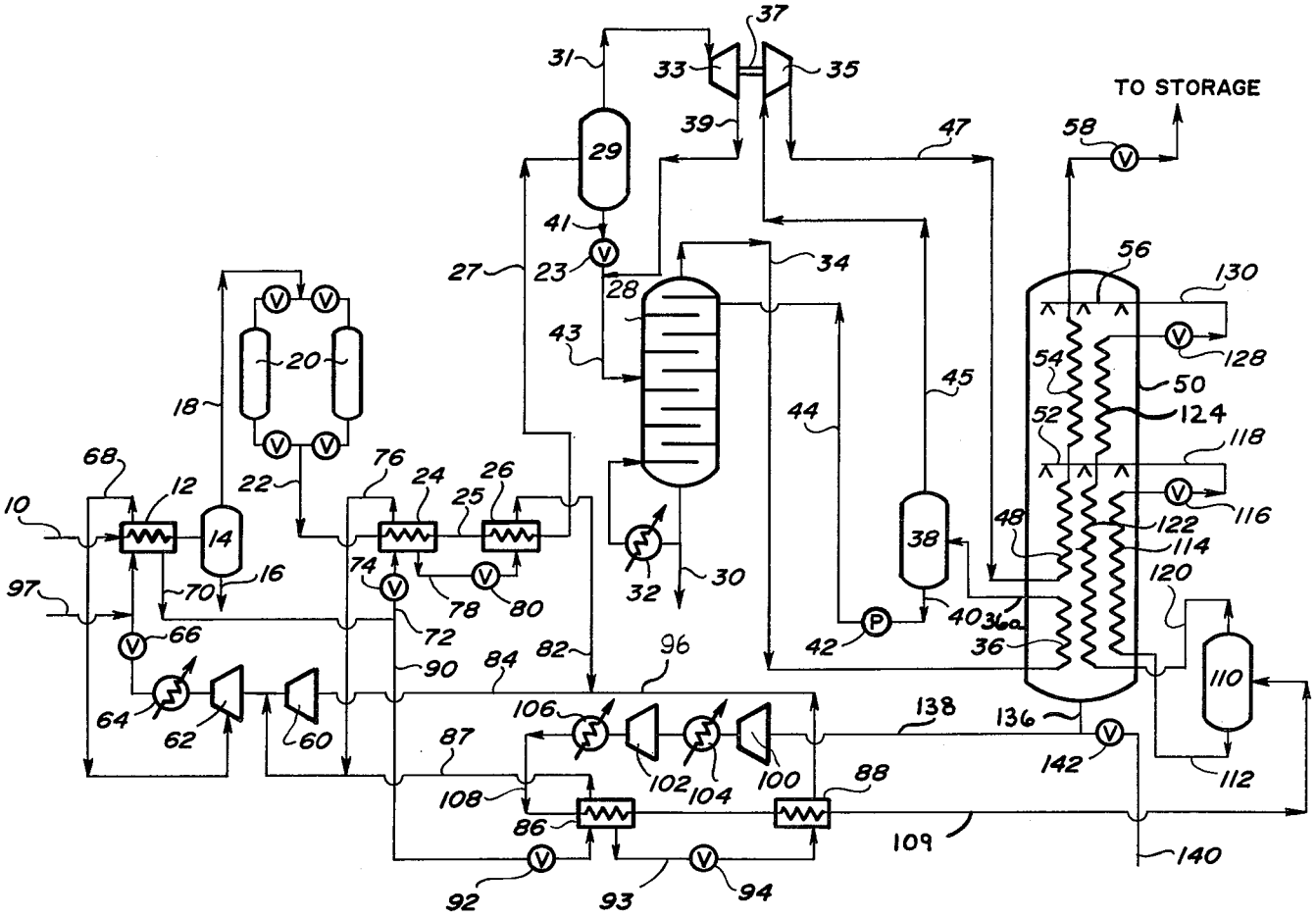
TO STORAGE

PROCESS FOR MANUFACTURING LIQUEFIED METHANE

BACKGROUND OF THE INVENTION

Natural gas shortages and increased prices for natural gas resulting from such shortages have resulted in substantial efforts to produce liquefied natural gas from a hydrocarbon feedstock near the well site of major gas producing countries to permit transportation to a foreign consumer. Because of the extreme amount of energy involved in the production of liquefied natural gas (LNG), the complete cycle including distillation for removing condensible components from the hydrocarbon feedstock and the refrigeration cycle for liquefying the methane obtained from the distillation cycle, must be extremely efficient in order to compete with other fuel sources. Also increased energy costs in producing liquefied natural gas result in decreased profits.

DESCRIPTION OF THE PRIOR ART

U.S. Pat. No. 3,702,541 discloses a process for removing condensible components from a hydrocarbon feedstock containing a substantial proportion of methane. In that process, the feedstock is cooled to a temperature below 0° F and expanded through a turbine to produce a gas condensate mixture which is fractionated to remove condensible components and yield a methane containing overhead. The overhead is cooled in a heat exchanger, and expanded again, followed by flowing the expanded gas through the heat exchanger and then the expanded gas is recompressed using the energy output of the expansion means. The gas is delivered to a pipeline.

U.S. Pat. No. 3,792,590 discloses a method for liquefying natural gas comprising drying a natural gas feedstock by passing it through a series of driers and filters, splitting the feedstock into a major and minor fraction with the minor fraction being passed through carbon dioxide adsorbers and then through a refrigeration cycle for liquefaction. The major fraction is work expanded and passed through a heat exchanger for high temperature level refrigeration. The energy of expansion of the major fraction is used to drive the main compressors for the refrigeration cycle.

It is also known to modify the process shown in U.S. Pat. No. 3,763,658 and produce liquefied methane from a hydrocarbon feedstock by isenthalpically expanding the gas from the supply pressure to a lower pressure, distilling the hydrocarbon feedstock at the lower pressure to form an overhead fraction rich in methane and then liquefying the overhead in a refrigeration cycle.

SUMMARY OF THE INVENTION

Briefly, this invention relates to a process for producing liquefied methane from a methane containing hydrocarbon feedstock. In this process, the feedstock is isentropically expanded to a first pressure level which is below the critical pressure of either the overhead or bottom fraction obtained on fractionation. Then the feedstock is fractionated, generally at the first pressure level, to form an overhead rich in methane. The overhead is compressed to a second pressure level in a compressor utilizing the energy obtained from the expansion to drive the compressor. Afterward, the compressed overhead is liquefied in a refrigeration cycle thereby forming liquefied methane or LNG.

Advantages of this invention include:

- the ability to fractionate valuable gaseous constituents from the hydrocarbon feedstock at pressure well below the critical pressure without substantially sacrificing liquefaction efficiency;
- the ability to recover energy from the hydrocarbon feedstock to enhance liquefaction efficiency in a relatively simple manner, i.e. by utilizing the energy obtained on expanding the hydrocarbon feedstock to the fractionation pressure for recompressing the methane rich overhead prior to liquefaction; and
- the ability to recover methane from a hydrocarbon feedstock and liquefy the methane in a more efficient process than used heretofore.

THE DRAWING

The drawing is a process flowsheet of a preferred embodiment of the cycle contemplated for producing liquefied methane from a gaseous hydrocarbon feedstock.

DESCRIPTION OF THE PREFERRED EMBODIMENTS

Generally, feedstocks suitable for use in the process cycle of this invention have a methane content of from about 60 to about 90 mol percent, and the balance comprising nitrogen and heavier hydrocarbons. These feedstocks then are fractionated for forming an overhead, usually rich in methane and a bottom rich in heavy hydrocarbons.

The hydrocarbon feedstock, after having been freed of carbon dioxide impurities, enters the system through line 10 and is passed through a first heat exchanger 12 which forms the first of three, cascade heat exchangers which are supplied with a single component refrigerant such as a $C_2$, $C_3$ or $C_4$ paraffin hydrocarbon. Generally, propane is used as the single component hydrocarbon refrigerant as it has been found that optimum temperatures can be obtained at the most ideal pressures.

The hydrocarbon feedstock is cooled against the propane in heat exchanger 12 to a first temperature level in the order of 70° F and is passed to a phase separator 14 from which condensed water is removed and discharged through line 16. The partly dried hydrocarbon feedstock is then passed through line 18 to one or the other of a pair of driers 20 which remove substantially all of the remaining water from the hydrocarbon feedstock. The driers contain a suitable well known desiccant, e.g. activated alumina, and are suitably piped and valved so as to be capable of alternate regeneration as is well known in the art. The dried hydrocarbon feedstock then is passed through line 22 to a second single component refrigerant heat exchanger 24 wherein the feedstock is cooled to approximately 9° F. The cooled hydrocarbon feedstock is removed from heat exchanger 24 through line 25 and directed to a third single component heat exchanger 26. There it is cooled to a temperature of about −27° F.

Typically, the stream removed from heat exchanger 26 will flow at a rate of 26,201 pound mols per hour of a hydrocarbon feedstock comprising in mole percent, approximately 0.35% nitrogen, 83% methane, 10.5% ethane, 3.7% propane, 0.65% isobutane, 1.03% butane, 0.23% isopentane, 0.18% pentane and 0.18% hexane at a temperature of −27° F and a pressure of 860 psia. The cooled feedstock is removed through line 27 to phase separator 29, wherein it is separated into a liquid phase and a vapor phase. The vapor is removed through line 31 and then is directed to a combination expander-compressor with the expander 33 and the compressor 35 being mounted on common shaft 37. The hydrocarbon feedstock is isentropically expanded from a pressure of about 860 psia to a pressure of 480 psia and during the expansion is cooled (by result of the work expended) to a temperature of about −72° F. The exhaust from expander 33 is directed through line 39 and combined with the liquid from line 41 coming from the bottom of phase separator 29, the latter of which has been reduced in pressure through throttling valve 23, and the combined stream is directed by line 43 to scrub column 28, from which heavy hydrocarbons are removed from the gaseous hydrocarbons as condensate through discharge line 30. A minor amount of lighter hydrocarbons including methane, ethane and propane are also removed and may be sent to a fractionation system (not shown) so as to provide make-up refrigerant as will be subsequently described. A major portion of the flow from the bottom of scrub column 28 is recirculated through steam reboiler 32 so as to provide vapor through the bottom trays of the column. Typically, it is necessary to remove the heavier hydrocarbons in this process because if they are not removed, they will freeze in the liquefaction cycle downstream and plug the equipment. In addition, it is often desirable to recover components from the feed, depending on their content in the feed, and their relative value as separate products such as ethane, propane, butane and gasoline.

Fractionation at the supply pressure of 860 psia is undesirable because the desired overhead rich in methane, at that pressure, is substantially at or slightly above its critical pressure. At and above the critical pressure, and even slightly below, the liquid and vapor densities are approximately the same, and therefore it is difficult to fractionate the gas from the liquid. Generally, a reduction in pressure to at least about 20% below the critical pressure of either the overhead and bottoms fraction, whichever is lower, or to a pressure in the range from about 750 to about 650 psia provides sufficient distinction between the vapor and liquid phase densities to achieve adequate distillation or fractionation. Preferably, the pressure is reduced to the range from about 200 to about 650 psia to achieve optimum fractionation.

Approximately 27,484 lb. mols per hour of a natural gas feedstream rich in methane, e.g. about 93%, leaves scrub column 28 as overhead vapor. Generally, the overhead comprises from above 80% and preferably above 90% methane. The overhead vapor, then is passed through line 34 to a first tube bundle 36 in main heat exchanger 50 and cooled from a temperature of about −86° F to a temperature of about −111° F by a multi-component refrigerant. The cooled vapor is removed from the first tube bundle 36 of main heat exchanger 50 by means of line 36*a* and passed to a second phase separator 38 from which additional condensed hydrocarbons are separated. The liquid condensate is passed through line 40 back to scrub column 28 via pump 42 and line 44 so as to provide reflux for scrub column 28. The overhead, rich in methane, leaves the top of phase 38 as vapor via line 45. As it leaves phase separator 38, it is at a pressure of approximately 465 psia and a temperature of −112° F.

It is in the next series where plant efficiency is enhanced as compared to the prior art. In this series, approximately 22,479 lb. mols per hour overhead are removed from phase separator 38 through line 45 and directed to compressor 35 driven by expander 33 via shaft 37 and compressed to the maximum pressure possible by all of the work obtained from expander 33, i.e. 680 psia. In other words, the energy for compression of the methane rich overhead is obtained by utilizing the energy of expansion of the hydrocarbon feedstock on letdown to the fractionation or distillation pressure. Heretofore, the methane rich overhead was directed without compression to the liquefaction cycle; and as a result, the efficiency of the overall liquefaction cycle was substantially reduced. Often in the past, it was customary to keep the inlet pressure high, e.g. 650 to 700 psia even through the distillation cycle in order to minimize power consumption. However, the fractionation was inefficient. The advantage of this process is that one can reduce the pressure well below the critical pressure of either the overhead or bottom fraction to be produced, distill and achieve desirable fractionation without substantially sacrificing overall plant efficiency. This is because the methane rich overhead can be compressed to a substantially higher pressure by the energy obtained on expansion to make the process more efficient.

The methane rich overhead, after compression, can be liquefied by conventional refrigeration cycles, i.e. either by Joule-Thompson, isentropic expansion or cooled against a liquid refrigerant. The preferred liquefaction cycle as shown in the drawing uses a multi-component refrigerant in a commercially available coil wound heat exchanger.

In the liquefaction cycle, the compressed overhead stream is passed through line 47 to one tube circuit 48 of a two-zone main heat exchanger 50. The overhead stream is passed upwardly through the circuit 48 and is cooled by a counterflow of a first multi-component refrigerant fraction sprayed downwardly over the tube circuit from spray header 52. This multi-component refrigerant portion generally comprises 2–12 mol % nitrogen, 35–45 mole % methane, 32–42 mol % ethane and 9–19 mol % propane. In this case, the refrigerant comprises 10 mol % $N_2$, 40 mol % $CH_4$, 35 mol % $C_2H_6$ and 15 mol % $C_3H_8$. The methane rich overhead is passed directly into second tube circuit 54 and upwardly through this tube circuit in which it is cooled by a second counterflowing multi-component refrigerant fraction sprayed downwardly from spray header 56. The overhead is withdrawn from the top of tube circuit 54 as a totally liquid and subcooled stream having a temperature in the order of −264° F and a pressure in the order of 550 psia. The liquefied and deeply subcooled feedstream is then expanded in valve 58 to a pressure in the order of 75 psia and a temperature in the order of −258° F. Because of the deep subcooling, no flash occurs and the liquid may be delivered directly to a storage tank in which it may be stored at atmospheric pressure and at a temperature in the order of −258° F. Approximately 22,478 lb. mols per hour of LNG are obtained.

Referring back to heat exchangers 12, 24 and 26, the propane, or other single component refrigerant is compressed in a compressor having a first stage 60, and a second stage 62 which includes a suction stream to an intermediate wheel. The compressed propane is cooled and totally condensed in water cooler 64 and is expanded from a pressure of 202 psia in valve 66 before entering heat exchanger 12 to a pressure of approximately 116 psia and by such expansion is cooled from 105° F to 65° F. Heat exchanger 12, as well as other propane exchangers, may be of conventional design as, for example, having U tubes submerged in liquid propane. Thus, a portion of the liquid propane is vaporized in cooling the hydrocarbon feedstock in the U tubes, and this vapor is returned through line 68 to the intermediate wheel in stage 62. The remaining liquid refrigerant from heat exchanger 12 is passed through line 70 to branch line 72 and 90. The portion in branch line 72 is expanded by valve 74 to a pressure in the order of 42 psia and is introduced into heat exchanger 24 at a temperature in the order of 4° F. A second portion of the liquid refrigerant is vaporized in cooling the feedstream in heat exchanger 24 and is returned through line 76 to the first wheel of stage 62. The remaining liquid propane from heat exchanger 24 is passed through line 78 and expanded in valve 80 to a pressure in the order of 18 psia, and is introduced into heat exchanger 26 at a temperature in the order of −35° F. This portion of the refrigerant is vaporized in cooling the feedstream and the refrigerant vapor is returned through lines 82 and 84 to the suction side of stage 60. Thus, it will be apparent that the feedstream is successively cooled in three single component refrigerant heat exchangers, wherein the same refrigerant is utilized at progressively decreasing pressures and temperatures in a three stage, cascade refrigerant cycle.

In addition to cooling the hydrocarbon feedstock in the above-described cascade cycle, the single component refrigerant is also utilized to cool, and partly condense, the multi-component refrigerant which is substantially utilized to liquefy and subcool the overhead at main heat exchanger 50. This cooling of the multi-component refrigerant by the single component refrigerant is effected in heat exchangers 86 and 88 by the second portion of the liquid propane from exchanger 12 which is supplied through main line 70 and branch line 90. This portion of the propane refrigerant is expanded in valve 92 to a pressure in the order of 42 psia and is introduced into heat exchanger 86 at a temperature in the order of 4° F. A portion of the propane is vaporized in cooling the multi-component refrigerant, and is withdrawn from exchanger 86 through line 87 and is returned to the first wheel of stage 62. The remaining liquid propane is passed from exchanger 86 to exchanger 88 via line 93 and expansion valve 94 such that the propane enters heat exchanger 88 at a pressure in the order of 18 psia and at a temperature of approximately −35° F. This portion is vaporized in cooling the feedstock and the refrigerant vapor is returned to the suction side of compressor 60 via lines 96 and 84. In order to compensate for any loss of refrigerant from the propane cycle due to leakage to the atmosphere, a make-up line 97 may be provided downstream of valve 66 so that fresh liquid propane may be added to the suction side of compressors 60 and 62 if adequate liquid propane is not available in the system.

The multi-component refrigerant comprising 10 mol % $N_2$, 40 mol % $CH_4$, 35 mol % $C_2H_6$ and 15 mol % $C_3H_8$ is compressed in compressors 100 and 102 having an intercooler 104, and an after-cooler 106. The pressure of the multi-component refrigerant vapor in line 108 generally may vary from about 500–1200 psia. For this case, in line 108 the pressure is about 650 psia and the temperature is about 105° F. The multi-component refrigerant is passed through line 108 to heat exchanger 86 where it is subcooled by the propane and then it is passed directly through second propane exchanger 88 from which it is discharged at a pressure of 635 psia and at a temperature in the order of −27° F. It is withdrawn through line 109 and sent to phase separator 110.

The liquid condensate in phase separator 110 is passed through line 112 to tube circuit 114 of main heat exchanger 50 wherein it is subcooled to a temperature in the order of about −170° F. This subcooled liquid is expanded in valve 116 to a pressure in the order of about 50 psia whereby a small portion flashes to vapor and the temperature drops to about −182° F. This liquid, and the flashed vapor, is injected into heat exchanger 50 via line 118 and spray header 52 so as to provide refrigerant flowing downwardly over the circuits 36, 48, 122 and 114.

Referring back to phase separator 110, the overhead vapor is passed through line 120 to tube circuit 122 wherein the vapor is cooled and condensed by reason of the downwardly sprayed multi-component refrigerant fraction. The condensed multi-component refrigerant in tube circuit 122 passes directly into a second tube circuit 124 wherein it is subcooled to a temperature in the order of −262° F. This subcooled liquid fraction is expanded in valve 128 to a pressure in the order of 51 psia whereby a small portion is flashed to vapor and the temperature drops to approximately −269° F. This liquid and flashed vapor is injected into exchanger 50 via line 130 and spray header 56 so as to provide downwardly flowing refrigerant over the tube circuits 54 and 124 after which it joins with the multi-component fractions from spray header 52. The combined multi-component is then vaporized in heat exchange with tube circuits 36, 48, 114 and 122. As a result, all of the multi-component refrigerant is recombined and in the vapor phase at the bottom of heat exchanger 50 and is withdrawn and passed through lines 136 and 138 to the suction side of compressor 100. Thus, the multi-component refrigerant portion of the system forms a separate, closed cycle whereby the methane overhead is most efficiently cooled from a propane level down to the final subcooled temperature of about −264° F.

A make-up line 140 and valve 142 may be provided to add such multi-component refrigerant as is required to compensate for unavoidable losses. As previously mentioned, this make-up refrigerant may be obtained by fractionating the hydrocarbons discharged through line 30 from fractionation column 28 and adding additional nitrogen.

The above case illustrates an embodiment of the invention where it is possible to achieve optimum and desirable fractionation of the gaseous hydrocarbons from the heavy hydrocarbons without substantially sacrificing liquefaction efficiency. In the prior art, for example, fractionation was conducted at a pressure of about 700 psia followed by liquefaction at the same pressure. Lower pressures for fractionation were not used because of the increased power cost necessary for achieving desirable efficiency for liquefaction.

A second case can be visualized which illustrates the combined advantages of this invention, namely the ability to fractionate at optimum or desirable pressures and yet obtain excellent liquefaction efficiency. For example, if the supply pressure of the hydrocarbon feedstock is approximately 1200 psia, it is possible to expand to 480 psia, fractionate and then compress the overhead back up to about 750 psia prior to liquefaction utilizing the energy obtained from the expansion. Thus, one can achieve desirable fractionation and yet obtain good liquefaction efficiency. On the other hand, when the prior art processes are used for a feedstock at the same pressure, the feedstock is isenthalpically expanded, fractionated at 700 psia, and then liquefied at 700 psia. Clearly, the fracionation, as well as the liquefaction as used in the prior art cases utilizing the 1200 psia feedstock, is not as efficient as the process of this invention.

What is claimed is:

1. A liquefaction process for liquefying a natural gas feed stream comprising the steps of:

a. supplying said natural gas feed stream at a pressure at or above 860 psia, b. cooling said feed stream in a plurality of heat exchange zones in indirect heat exchange with a refrigerant in a separate, closed loop refrigeration system, c. isentropically expanding said feed stream to a first pressure which is below the critical pressures of both the overhead and bottom streams found in subsequent step (d) and thereby obtaining mechanical energy, d. fractionating the expanded feed stream in a scrub column to form an overhead stream rich in methane and a bottom stream rich in heavy hydrocarbons, e. cooling and partially condensing said overhead stream in indirect heat exchange with a multi-component refrigerant in a separate, closed loop refrigeration system, f. phase separating said partially condensed overhead stream into a liquid fraction rich in heavy hydrocarbons and a methane-rich vapor stream, g. supplying said liquid fraction to said scrub column as reflux, h. supplying said methane-rich vapor stream at a temperature below −100° F directly to a compressor, and compressing said stream to a pressure of at least 680 psia to form a high pressure methane-rich stream using the mechanical energy recovered in step (c), i. supplying said high pressure methane-rich stream to a heat exchange zone, j. cooling, liquefying and sub-cooling said high pressure methane-rich stream in said cooling zone in indirect heat exchange with said same multi-component refrigerant recited in clause (e), and k. withdrawing said liquefied and sub-cooled methane stream as an LNG product stream.

2. The liquefaction process as claimed in claim 1 in which said natural gas feed stream is supplied in clause (a) at a pressure in the range of 860 psia to 1,200 psia.

3. The liquefaction process as claimed in claim 1 in which said methane-rich vapor stream is compressed in clause (h) to a pressure in the range of 680 psia to 750 psia.

4. The liquefaction process as claimed in claim 1 in which said feed stream is expanded in clause (c) to a pressure within the range of 200 psia to 650 psia.

* * * * *

UNITED STATES PATENT AND TRADEMARK OFFICE

CERTIFICATE OF CORRECTION

PATENT NO. : 4,065,278

DATED : December 27, 1977

INVENTOR(S) : Charles L. Newton and Lee S. Gaumer

It is certified that error appears in the above-identified patent and that said Letters Patent are hereby corrected as shown below:

Column 2, Line 2
Delete "pressure" and substitute therefor -- pressures --

Column 3, Line 62
After "phase" and before "38", insert -- separator --

Column 4, Line 34
Delete "the" and substitute therefor -- tube --

Column 7, Line 19
Delete "found" and substitute therefor -- formed --

Signed and Sealed this

Ninth Day of May 1978

[SEAL]

Attest:

RUTH C. MASON
Attesting Officer

LUTRELLE F. PARKER
Acting Commissioner of Patents and Trademarks